US008348711B2

(12) United States Patent
Hitzschke et al.

(10) Patent No.: US 8,348,711 B2
(45) Date of Patent: Jan. 8, 2013

(54) FURNACE AND METHOD FOR PRODUCING A DISCHARGE LAMP

(75) Inventors: Lothar Hitzschke, München (DE); Frank Vollkommer, Gauting (DE)

(73) Assignee: Osram AG, Munich (DE)

( * ) Notice: Subject to any disclaimer, the term of this patent is extended or adjusted under 35 U.S.C. 154(b) by 327 days.

(21) Appl. No.: 12/452,654

(22) PCT Filed: Aug. 1, 2007

(86) PCT No.: PCT/EP2007/006819
§ 371 (c)(1),
(2), (4) Date: Jan. 13, 2010

(87) PCT Pub. No.: WO2009/015677
PCT Pub. Date: Feb. 5, 2009

(65) Prior Publication Data

US 2010/0197188 A1 Aug. 5, 2010

(51) Int. Cl.
*H01J 9/38* (2006.01)

(52) U.S. Cl. ..... 445/70; 445/44

(58) Field of Classification Search ..... 445/70, 445/73, 26, 44, 66
See application file for complete search history.

(56) References Cited

U.S. PATENT DOCUMENTS

| | | | | |
|---|---|---|---|---|
| 4,082,392 | A | 4/1978 | Golin | |
| 4,383,723 | A * | 5/1983 | Schleimann-Jensen | 445/54 |
| 6,837,767 | B2 | 1/2005 | Hitzschke et al. | |
| 7,261,610 | B2 | 8/2007 | Hitzschke et al. | |
| 2003/0060116 | A1 | 3/2003 | Hitzschke et al. | |

FOREIGN PATENT DOCUMENTS

| | | | |
|---|---|---|---|
| DE | 101 47 727 | A1 | 9/2001 |
| DE | 102 25 612 | A1 | 6/2002 |
| DE | 10 2004 057 897 | A1 | 12/2004 |
| GB | 1 015 802 | | 1/1966 |
| GB | 1015802 | A | 1/1966 |

OTHER PUBLICATIONS

Chinese Office Action dated May 5, 2011.

* cited by examiner

*Primary Examiner* — Anh Mai
*Assistant Examiner* — Andrew Coughlin
(74) *Attorney, Agent, or Firm* — Holtz, Holtz, Goodman & Chick, PC

(57) ABSTRACT

The invention relates to a furnace (1) for producing a discharge lamp, comprising an outer furnace wall. It is characterized by a hollow body (2) that surrounds the outer furnace wall and is provided to receive discharge vessel parts (4, 5) and joints of the same to a discharge vessel (8) for the discharge lamp. The hollow body (2) further comprises a discharge gas supply (9) for flooding with a discharge gas such that a discharge vessel (8) provided in the hollow body (2) is filled with the same. The invention further relates to a production method for discharge lamps comprising such a furnace (1).

13 Claims, 3 Drawing Sheets

FURNACE AND METHOD FOR PRODUCING A DISCHARGE LAMP

This application is a U.S. National Phase Application under 35 USC 371 of International Application PCT/EP2007/006819, filed Aug. 1, 2007, which is incorporated herein in its entirety by this reference.

TECHNICAL FIELD

The present invention relates to a furnace for producing a discharge lamp, and to a method for producing a discharge lamp using such a furnace.

PRIOR ART

Discharge lamps have a closed discharge vessel containing a discharge gas. It is known to assemble a plurality of discharge vessel parts to form a discharge vessel in a furnace by supplying heat. It is known in particular to assemble discharge vessel parts in a vacuum furnace under a discharge gas atmosphere.

DE 101 47 727 A1 discloses a continuous furnace for assembling discharge vessel parts to form discharge vessels. In this case the discharge vessel parts are introduced into an atmosphere of the discharge gas and assembled under this atmosphere.

SUMMARY OF THE INVENTION

It is an object of the invention to provide a furnace which is advantageous in respect of the production of a discharge lamp, and to provide a corresponding production method.

The invention relates to a furnace for producing a discharge lamp, having an outer furnace wall, characterized by a first hollow body enclosed by the outer furnace wall for receiving discharge vessel parts and assembling them to form a discharge vessel for the discharge lamp, and a discharge gas feed into the first hollow body for flooding it with a discharge gas, so that a discharge vessel assembled in the first hollow body is filled with this gas, and to a production method using this furnace.

Preferred configurations are the subject matter of the dependent claims and will likewise be explained in more detail below. The disclosure relates both to the furnace and to the production, even though this is not explicitly stated everywhere.

The invention is based on the discovery that, for discharge vessel parts which are assembled in a furnace under a discharge gas atmosphere, for example under a neon/xenon atmosphere, much larger amounts of discharge gas are consumed than is finally enclosed in the assembled discharge vessels. First, this is due to the usually comparatively large interiors of the furnaces used. Secondly however, depending on the furnace, the discharge gas may also escape from the furnace—this is the case above all with continuous furnaces. On the one hand this is economically detrimental since some of the gases used, for instance xenon, contribute significantly to the costs of the discharge lamps. Furthermore, the discharge gas may however also comprise components for which large consumption and possible escape into the environment should be avoided for other reasons, for instance in the case of chemically reactive and/or toxic gases.

The invention is based on the idea of enclosing a comparatively small volume inside the furnace with a hollow body, and introducing the discharge gas into this smaller volume. The hollow body is flooded with the discharge gas and the discharge vessel parts are assembled inside the hollow body, so that the assembled discharge vessel is then filled with the discharge gas.

The hollow body may also comprise openings, which will be discussed further, through which the discharge gas can escape from the hollow body into the furnace. A flow leading outward can thus be established. By flushing, the discharge vessel parts can be cleaned and furthermore contaminants possibly existing in the hollow body, for instance particles and undesired gases, can be kept away from the discharge vessel parts and removed from the hollow body.

Even though some of the discharge gas can escape from the hollow body in the case of a hollow body with openings, in any event only a comparatively small volume is flooded with the discharge gas so that the discharge gas consumption can be kept comparatively small.

It is also advantageous that furnaces known per se, or their technology, can be employed in the invention. Nevertheless, furnaces already in operation may be retrofitted with a hollow body according to the invention.

In principle, a furnace according to the invention may also be configured for changing the hollow body. Different hollow bodies can then be optimized for different discharge lamp types, for example by making them enclose the respective discharge vessel parts and discharge vessels as tightly as possible.

Assuming essentially horizontal transport, the available internal height in the opening of the hollow body above the transport plane, for instance a conveyor belt, is of particular importance in this case. Preferably, this internal height should be at most 5 times, particularly preferably at most 3 times, and in the most favorable case at most two times the maximum thickness of the discharge vessels or discharge vessel parts which have to travel through. Tight enclosure below the transport plane is naturally also desirable, even though it is of secondary importance in comparison with the internal height above.

The discharge gas, with which the hollow body is flooded through the gas feed, may preferably contain helium, neon, argon, xenon or a mixture of these gases, and in particular neon on its own. A neon/xenon mixture is furthermore preferred as a discharge gas.

So-called batch operation is preferably not carried out in the invention, i.e. separate heating and cooling operations are not respectively employed for particular batches of discharge vessels or discharge vessel parts. Instead, the discharge vessel parts and discharge vessels are put into and taken out of a furnace operated continuously.

In a preferred embodiment the furnace is a continuous furnace, which is particularly suitable for a high throughput. One opening is used to introduce discharge vessel parts and another opening is used to extract discharge vessels. In a continuous furnace, transport through the furnace is carried out for instance using a conveyor belt. A suitable hollow body correspondingly has a first opening for introducing discharge vessel parts and a second opening for extracting discharge vessel parts. The discharge vessel parts are transported into the hollow body and assembled in it, and the assembled discharge vessel parts are in turn transported out of it.

Preferably, the total area of the openings of the hollow body is much less than the total area of the openings in the outer furnace wall. A minimal total area of the openings of the hollow body can restrict the escape of discharge gas. Here again, it is essentially the region above the transport plane which is important. The cross-sectional area of the hollow body openings above the transport plane should preferably be at most 5 times, particularly preferably at most 3 times and in the most favorable case at most two times the corresponding cross-sectional area (in the same viewing direction) of the discharge vessel parts or discharge vessels.

Preferably, the furnace is configured to let a gas flow along past the openings of the hollow body. The flow can impede the ingress of contaminants into the hollow body, and preferably substantially prevent it. The gas flowing along past the openings acts as a flow barrier comparable with air curtains at the entry of large buildings.

If the furnace according to the invention is configured as a continuous furnace, it preferably comprises a second hollow body. The further hollow body likewise comprises openings for introducing and extracting the discharge vessel parts, so that the discharge vessel parts can also be transported through the second hollow body. Along the transport path of the discharge vessel parts, the second hollow body precedes the first hollow body (for assembling the discharge vessel parts). A flushing gas for cleaning the discharge vessel parts, preferably argon or helium, is introduced through a gas feed into this second hollow body. There is preferably likewise a flow past its openings, similarly as for the openings of the first hollow body.

Preferably, for a continuous furnace, the first hollow body is elongate, for instance tubular with an essentially square cross section, its openings for introducing the discharge vessel parts and extracting the discharge vessels preferably lying at the opposite ends of the hollow body. If contaminants enter the first hollow body through the openings, this will primarily affect the volume in the vicinity of the openings. It is therefore preferable for the first hollow body to be at least a factor of 50 longer along the throughput direction than it is high (expressed in terms of internal dimensions). A factor of 80 or even 120 is more preferred as a lower limit. For the second hollow body, an elongate design is preferred as for the first hollow body.

A preferred embodiment comprises a pump for pumping gases out of the first hollow body. On the one hand, pumping can establish a flow for flushing, and on the other hand the discharge gas or components of the discharge gas, in particular xenon, can be recovered.

It is furthermore preferable to connect at least one pump through two suction openings to the first hollow body, in particular one pump respectively at each of the two suction openings. In this case, a first of the suction openings lies closer to the first opening and the second suction opening lies closer to the second opening of the hollow body. Contaminants which enter can at least partially be pumped off through the two suction openings, so that the purity of the volume lying between the two suction openings can be improved further.

There is preferably a further gas feed between the first suction opening and the first opening, as well as a further gas feed between the second suction opening and the second opening. Argon, helium or neon is preferably introduced from these two gas feeds and may above all be pumped off through the suction opening respectively lying closest, so that a flow acting as a barrier can be formed. Optionally, parts of the gases introduced through the two gas feeds may also escape from the openings of the hollow body, and thus reinforce the barrier effect.

Preferably, the first hollow body is composed of a plurality of parts. The individual parts may—naturally with the exception of the transport openings—be hermetically connected. As an alternative, the discharge gas may also flow out of the hollow body between the parts—owing to a positive pressure. In addition, vacuum channels may be embedded lengthwise in the edges of the parts and likewise, by suction, impede particles and undesired gases from entering the hollow body.

Preferably, the furnace according to the invention is configured for the production of a flat radiator. In a flat radiator, the discharge vessel is configured to be flat and have a relatively large format. Conventionally, the long sides of the flat radiator are formed by two essentially plane-parallel plates. The plates may be structured and, despite the name "flat radiator", need not be flat in the strict sense of the word.

As mentioned, the invention also relates to a method for producing a discharge lamp in a furnace, as already revealed by the description above. In particular, the production of a dielectric barrier discharge lamp is preferred.

Preferably, the first hollow body is flooded with the discharge gas so that it flows out of the openings of the hollow body during the flooding. In the case of multipart hollow bodies, a flow directed outward between the parts is also preferred. Ingress of contaminants into the interior of the hollow body can thus be substantially avoided.

In the case of a continuous furnace, it is preferable for a gas to flow around the discharge vessel parts counter to their transport direction, and for a gas to flow around the discharge vessel along its transport direction. In this case, a flow movement component projected into the transport plane is to be considered. This may relate both to the gases in the hollow body and to gases for flowing past the openings of the hollow body. Contaminants will therefore be flushed away from the actual, assembly zone.

BRIEF DESCRIPTION OF THE DRAWINGS

The invention will be explained in more detail below with the aid of exemplary embodiments. Individual disclosed features may also be essential to the invention in combinations other than those shown.

In the figures.

PREFERRED EMBODIMENT OF THE INVENTION

Figure 1:
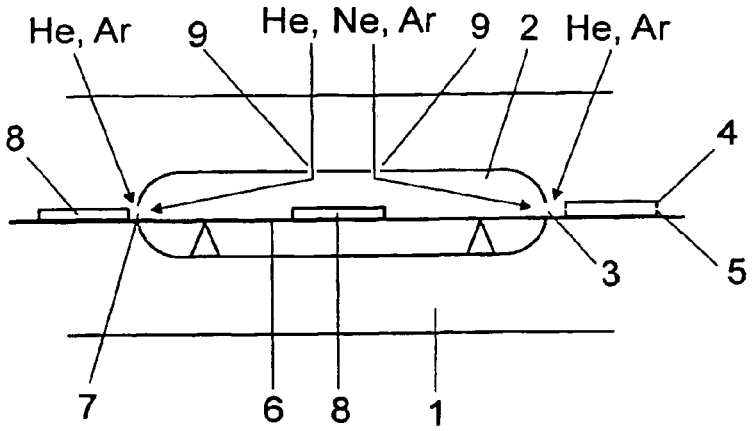
FIG. 1 shows a furnace according to the invention as a first exemplary embodiment.

FIG. 1 shows a continuous furnace 1 for producing dielectric barrier flat radiators. The continuous furnace 1 comprises a tubular hollow body 2 which is approximately 160 times as long as it is high (expressed in terms of the internal dimensions), i.e. it is not represented true to scale. For example, the dimensions of 8 m length, 60 cm width and 5 cm height may be envisaged. It has an opening 3 for introducing discharge vessel parts 4 and 5.

During operation, the discharge vessel parts 4 and 5 are introduced into the hollow body 2 and moved through it using a conveyor belt 6 known per se. Closed discharge vessels 8 then leave the hollow body 2 through the opening 7 of the hollow body 2. It is thus a "first" hollow body. The total area of the openings 3 and 7 of the hollow body 2 is much less than the total area of the openings (not shown) of the furnace 1.

A discharge gas is introduced into the hollow body 2 through the gas feeds 9 during operation, and specifically helium, neon, argon or a mixture of these gases. Helium or argon flows past the two openings 3 and 7 of the hollow body 2, so that contaminants from the furnace interior do not enter the hollow body 2. A discharge gas flow from the approximately centrally placed gas feeds 9 to the openings 3 and 7, which results from a moderate positive pressure, is set up in the hollow body 2.

The furnace heats the interior of the hollow body 2. The discharge vessel parts 4 and 5 are initially separated from one another in a manner known per se by $SF_6$ glass spacers (cf. DE 101 47 727 A1). These soften during transport through the hollow body 2, so that the discharge vessel parts 4 and 5 are lowered onto one another and assembled together by a glass solder (not shown) previously applied onto the edges. Discharge gas is thereby enclosed in the assembled discharge vessel 8.

Figure 2:
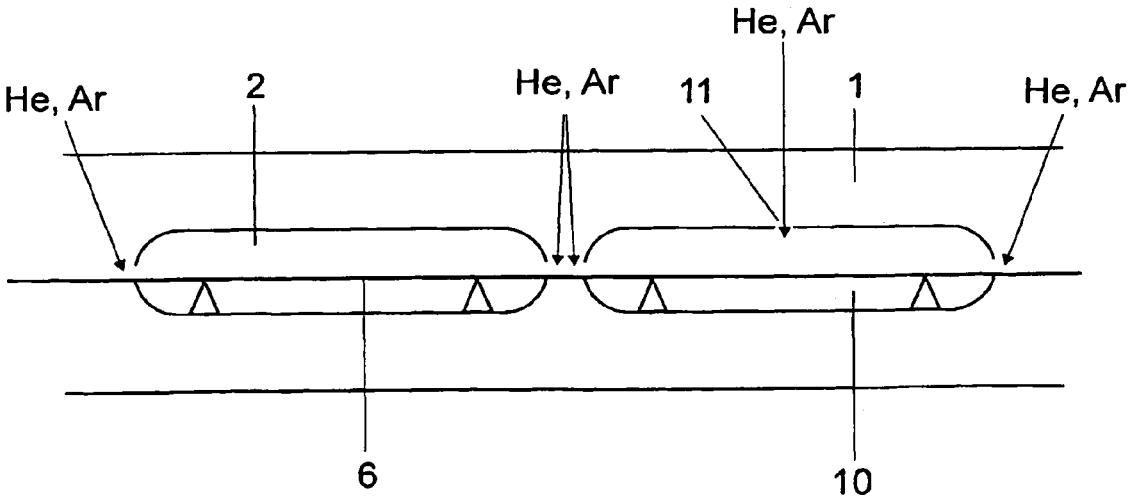
FIG. 2 shows a variant of the furnace in FIG. 1 as a second exemplary embodiment.

FIG. 2 shows the furnace 1 of FIG. 1. In contrast to FIG. 1, however, a second hollow body 10 is additionally introduced here. The transport device 6 carries the discharge vessel parts first through the second hollow body 10 and subsequently through the first hollow body 2. The second hollow body 10 is used to pre-clean the discharge vessel parts, which to this end are flushed with argon or helium through a gas feed 11 in this hollow body.

Figure 3:
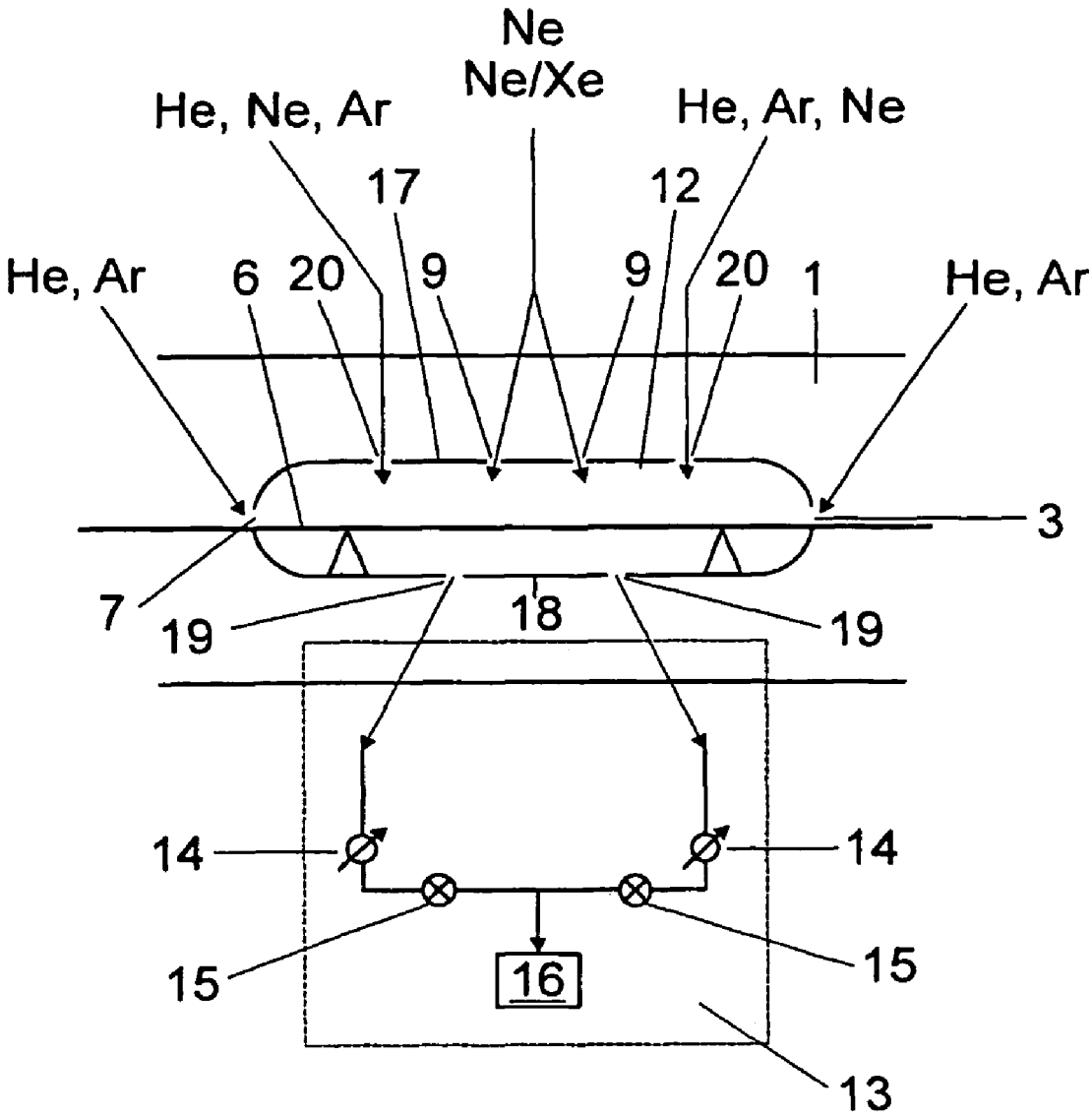
FIG. 3 shows another variant of the furnace in FIG. 1 as a third exemplary embodiment.

FIG. 3 shows the furnace 1 of FIG. 1, but with a modified (first) hollow body 12 and a pumping and recovery device 13 with two pumps 14, two volumetric flow meters 15 and a device 16 known per se for recovering noble gases. The hollow body 12 is now constructed in two parts—with an upper top 17 and a lower bottom 18. Owing to the perspective shown, however, none of the "equatorial" circumferential joints are depicted. The bottom 18 and the top 17 bear on one another via flat edges (not shown). A vacuum channel, extending along the entire edge length, is introduced into the edges of the bottom 18. Such a vacuum channel is known for instance from DE 102.25 612 A1.

Here, either neon alone or a mixture of neon and xenon is introduced into the hollow body 12 through the gas feeds 9. A positive pressure is also set up in this hollow body 12. The gas contained in it therefore flows out of the openings 3 and 7 and through the circumferential joints. Suction openings 19 are additionally provided, through which the gas is pumped off from the hollow body 12 by means of the pumping and recovery device 13, and recovered. Depending on the gas composition, either xenon alone, neon alone or both xenon and neon are recovered.

Two further gas feeds 20 are provided along the length of the hollow body 12, and specifically one each between one of the suction openings 19 and the closest opening 3 or 7. Additional argon, helium or neon is introduced into the hollow body 12 through these further gas feeds 20. The gas from these further gas feeds 20 flows on the one hand to the suction openings 19, and on the other hand to the respectively closest opening 3 or 7. The central assembly region of the hollow body 12 is thus additionally protected against contaminants from the furnace 1.

Figure 4:
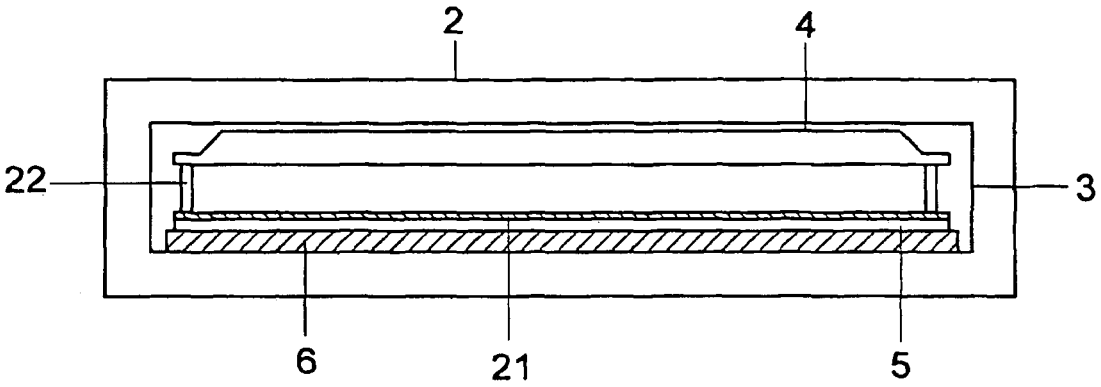
FIG. 4 shows a schematic representation in the transport direction with a view of an entry opening of the first exemplary embodiment.
Figure 5:
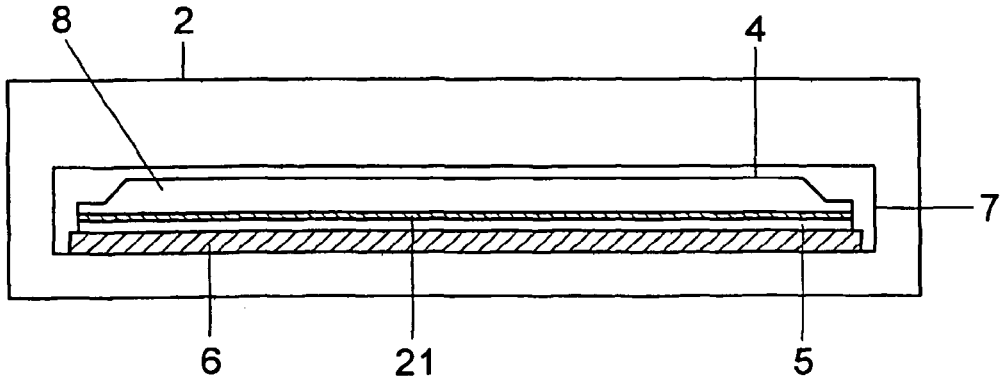
FIG. 5 shows a schematic representation in the transport direction with a view of an exit opening of the first exemplary embodiment.

FIGS. 4 and 5 illustrate the dimensioning, already variously mentioned, of the entry and exit openings (or first and second openings) in relation to the dimensions of the discharge vessel parts or the discharge vessel. For the input opening, as illustrated by FIG. 4, a larger height and a larger opening cross section of the discharge vessel parts are important. The input opening 3 is represented there as a rectangle as seen in the transport direction, the hollow body 2 being schematically depicted as a somewhat larger rectangle. In the input opening 3, it shows the discharge vessel top 4 arranged relatively far above (cf. FIG. 1) and the conveyor belt 6 arranged below and indicated schematically (cf. FIG. 1). The discharge vessel bottom 5 (cf. FIG. 1), which is covered with a glass solder layer 21 on the edge, lies on the conveyor belt 6. Above this, standing upright on the left and right edges spacers 22, made of $SF_6$ glass are indicated, which are softening during the assembly process and allow controlled lowering of the discharge vessel top 4 onto the bottom 5. Here, the height of the discharge vessel parts means the unavoidable total height due to this structure, made up of the discharge vessel bottom 5, the glass solder layer 21, the $SF_6$ glass spacers 22 and the discharge vessel top 4, which in total roughly occupies about 90% of the internal height of the opening 3. In respect of the cross-sectional areas, the same applies in principle: the projected area of the discharge vessel parts visible in this view seen in the transport direction plus the area enclosed between the discharge vessel bottom 3 and top 4 and the $SF_6$ glass spacers 22 is calculated for the discharge vessel parts. Here, this is approximately a good ¾ of the cross-sectional area of the opening 3 above the conveyor belt 6.

FIG. 5 similarly shows the output opening 7, which is configured to be lower than the input opening 3. After the assembly step, the $SF_6$ glass spacers 22 are compressed and are not represented here, so that now the discharge vessel top 4 bears on the discharge vessel bottom 5, or the glass solder layer 21. The overall discharge vessel 8 is thus lower than the structure in FIG. 4. The opening 7 is adapted to this, although this need not necessarily be the case. Here, the height of the discharge vessel 8 makes up about ¾ of the internal height of the opening 7 above the conveyor belt 6. The cross-sectional area of the discharge vessel 8 is also much more than half the cross-sectional area of the opening 7 above the conveyor belt 6.

The invention claimed is:

1. A furnace for producing a discharge lamp, the furnace comprising:

an outer furnace wall;

a first hollow body which is enclosed by the outer furnace wall and adapted to receive discharge vessel parts and to assemble the discharge vessel parts to form a discharge vessel for the discharge lamp; and a discharge gas feed into the first hollow body for flooding the first hollow body with a discharge gas, so that the discharge vessel assembled in the first hollow body is filled with the discharge gas;

wherein the furnace is configured as a continuous furnace in which a wall of the first hollow body comprises a first opening for introducing the discharge vessel parts and a second opening for extracting formed discharge vessels;

wherein a height of the first opening is higher than a height of the second opening, the height being an internal height above a transport plane of the discharge vessel parts and the discharge vessels;

wherein the first hollow body comprises two suction openings connected to a pump; and wherein a first of the suction openings is arranged closer to the first opening for introducing the discharge vessel parts, and a second of the suction openings is arranged closer to the second opening for extracting the formed discharge vessels.

2. The furnace as claimed in claim 1, wherein a gas flows from outside along the first hollow body at the first opening and at the second opening so that the gas flows impede ingress of contaminants into the first hollow body and entrain contaminants from an interior of the first hollow body.

3. The furnace as claimed in claim 1 or claim 2, wherein the furnace comprises a second hollow body with a gas feed for a flushing gas for flushing the discharge vessel parts when the discharge vessel parts pass through the gas feed.

4. The furnace as claimed in claim 1, wherein the first hollow body is at least a factor of 50 longer along a throughput direction than it is high.

5. The furnace as claimed in claim 1, further comprising a pump for pumping gases out of the first hollow body.

6. The furnace as claimed in claim 5, further comprising a device for recovering constituents of the discharge gas.

7. The furnace as claimed in claim 1, further comprising at least two further gas feeds into the first hollow body, wherein a first of the further gas feeds is arranged between the first of the suction openings and the first opening of the hollow body, and a second of the further gas feeds is arranged between the second of the suction openings and the second opening of the hollow body.

8. The furnace as claimed in claim 1, wherein the hollow body comprises a plurality of parts.

9. A method for producing a discharge lamp in a furnace configured for production of a flat radiator and having an outer furnace wall, the method comprising:

receiving discharge vessel parts in a first hollow body enclosed by the outer furnace wall;

assembling the discharge vessel parts to form a discharge vessel for the discharge lamp in the first hollow body; and flooding the hollow body with a discharge gas through a discharge gas feed before an end of assembly, so that the discharge vessel assembled in the hollow body is filled with the discharge gas;

wherein the first hollow body comprises a first opening for introducing the discharge vessel parts and a second opening for extracting formed discharge vessels;

wherein a height of the first opening is higher than a height of the second opening, the height being an internal height above a transport plane of the discharge vessel parts and the discharge vessels;

wherein the first hollow body comprises two suction openings connected to a pump; and wherein a first of the suction openings is arranged closer to the first opening for introducing the discharge vessel parts, and a second of the suction openings is arranged closer to the second opening for extracting the formed discharge vessels.

10. The method as claimed in claim 9, wherein the discharge gas, with which the hollow body is flooded, flows out of the first and second openings of the hollow body during the flooding.

11. The method as claimed in claim 9 or 10, wherein the furnace is configured as a continuous furnace, a gas flows around the discharge vessel parts counter to their transport direction, and a gas flows around the discharge vessel in its transport direction.

12. The method as claimed in claim 9, wherein the internal height of the first opening and the second opening above the transport plane is at most 5 times a thickness of the discharge vessel parts or the discharge vessels which are passed through.

13. The method as claimed in claim 9, wherein a cross-sectional area of the first opening and the second opening perpendicularly to a transport direction above the transport plane is at most 5 times a corresponding cross-sectional area of the discharge vessel parts or the discharge vessels which are passed through.

* * * * *